US007839619B2

(12) United States Patent
George et al.

(10) Patent No.: US 7,839,619 B2
(45) Date of Patent: Nov. 23, 2010

(54) STATIC ELECTRICITY ELIMINATOR

(76) Inventors: Kent J. George, 1606 Kirklee Rd., Charleston, WV (US) 25314; Keith J. George, 523 S. Fort Dr., Charleston, WV (US) 25314; D. Duane Gilliam, 835 Greenbo Rd., Argillite, KY (US) 41121

( * ) Notice: Subject to any disclaimer, the term of this patent is extended or adjusted under 35 U.S.C. 154(b) by 0 days.

(21) Appl. No.: 12/476,944

(22) Filed: Jun. 2, 2009

(65) Prior Publication Data

US 2009/0236008 A1 Sep. 24, 2009

Related U.S. Application Data

(63) Continuation of application No. 11/051,848, filed on Feb. 4, 2005, now Pat. No. 7,558,044.

(51) Int. Cl.
*H05F 3/06* (2006.01)
*B03C 3/38* (2006.01)

(52) U.S. Cl. ..... 361/231; 96/16; 96/17

(58) Field of Classification Search ..... 361/231; 96/16, 17

See application file for complete search history.

(56) References Cited

U.S. PATENT DOCUMENTS 2,108,759 A * 2/1938 Turman ..... 252/511
3,215,616 A * 11/1965 Spielman ..... 422/186.07
4,724,187 A * 2/1988 Ungar et al. ..... 428/408
5,938,823 A * 8/1999 Condit et al. ..... 96/16
6,393,718 B1 * 5/2002 Harris et al. ..... 34/96

* cited by examiner

*Primary Examiner*—Stephen W Jackson
*Assistant Examiner*—Zeev Kitov
(74) *Attorney, Agent, or Firm*—Ashley Law Firm PC; Stephen S. Ashley, Jr.

(57) ABSTRACT

An apparatus for reducing static electricity includes an ionizer that generates ions for neutralizing static electricity, a blower that produces a current of air for moving the ions to a desired location, and a motion detector operatively connected to the blower. Upon detecting motion, the motion detector activates the blower, which disperses ions to reduce static electricity at the desired location. The apparatus can include a heater for heating the current of ionized air. In addition, the motion detector can be operatively linked to the ionizer and heater so that they are also activated upon detection of motion. The blower can be linked to a timer such that it runs for a predetermined amount of time upon activation by the motion detector, or the blower can run continuously until the motion detector no longer detects any motion. The apparatus is particularly useful for reducing static electricity around fuel dispensers.

20 Claims, 3 Drawing Sheets

STATIC ELECTRICITY ELIMINATOR

This application is a continuation of application Ser. No. 11/051,848, filed Feb. 4, 2005, now pending.

TECHNICAL FIELD AND BACKGROUND OF THE INVENTION

The invention relates to an apparatus and method for reducing the amount of static electricity in a particular area. The invention particularly can be used to reduce static electricity around fuel dispensers in order to prevent injuries to motorists while fueling their vehicles.

The world petroleum marketing business continues to experience fuel fires and explosions as a direct result of static electricity buildup and discharge at fuel stations. Under certain conditions, such as cool, dry weather, and/or as the result of the particular clothing worn by a motorist engaged in fueling his vehicle, a static charge on the motorist will discharge when the motorist touches the fuel filler nozzle, thus igniting the fuel vapors and potentially causing serious bodily injury or death and major property damage. As a result, various disclaimers and warnings are now present at fuel pumps.

Various method have been developed in an attempt to prevent static electricity induced flash fires at fuel stations. For example, U.S. Pat. No. 2,108,759 discloses an antistatic gasoline dispensing nozzle. In addition, many fuel distribution systems are designed to ground static shocks. However, the problem of such static-induced flash fires persists.

SUMMARY OF THE INVENTION

Therefore it is an object of the present invention to provide an apparatus that neutralizes static electricity in a particular area.

Another object of the present invention is to provide an apparatus that reduces the risk of a static electricity-induced flash fire occurring while a motorist fuels his vehicle at a fuel dispenser.

These and other objectives of the present invention are achieved by providing an apparatus for reducing static electricity having an ionizer that generates ions for eliminating static electricity, a blower that produces a current of air for moving the ions to a desired location, and a motion detector operatively connected to the blower. Detection of motion by the motion detector activates the blower so that ions are dispersed to reduce static electricity at the desired location.

According to a preferred embodiment of the invention, the blower is a motorized fan, or a pressurized air line.

According to another preferred embodiment of the invention, the invention includes an air intake filter for supplying air to the blower.

According to yet another preferred embodiment of the invention, a timer is operatively connected to the blower, so that upon activation by the motion detector, the blower operates for a predetermined period of time and then automatically cuts off.

According to yet another preferred embodiment of the invention, the blower begins moving the ions upon activation by the motion detector, and continues to operate until the motion detector no longer detects motion.

According to yet another preferred embodiment of the invention, the blower and the motion detector are adapted for positioning proximate a fuel dispenser, so that motion proximate the fuel dispenser activates the blower to move ions proximate the fuel dispenser and reduce static electricity proximate the fuel dispenser.

According to yet another preferred embodiment of the invention, a housing contains the ionizer, the blower and the motion detector. The housing is positioned proximate a fuel dispenser such that motion proximate the fuel dispenser activates the blower to move ions proximate the fuel dispenser and reduce static electricity proximate the fuel dispenser.

According to yet another preferred embodiment of the invention, the motion detector is operatively connected to the ionizer such that detection of motion by the motion detector activates the ionizer.

According to yet another preferred embodiment of the invention, the static electricity eliminator includes a heating device for heating the ionized air being moved by the blower.

According to yet another preferred embodiment of the invention, a housing contains the ionizer, the blower, the motion detector and the heating device.

According to yet another preferred embodiment of the invention, the motion detector is operatively connected to the heating device such that detection of motion by the motion detector activates the heating device.

A preferred embodiment of the method of using the static electricity eliminator according to the invention includes providing an ionizer that generates ions for eliminating static electricity, and a blower that produces a current of air for moving the ions to a desired location. A motion detector is operatively connected to the blower such that detection of motion by the motion detector activates the blower and ions are moved to reduce static electricity at the desired location.

In another preferred embodiment of the method of using the static electricity eliminator according to the invention, the current of air produced by the blower is heated.

In another preferred embodiment of the method of using the static electricity eliminator according to the invention, an air intake filter is provided for supplying air to the blower.

Another preferred embodiment of the method of using the static electricity eliminator relates to reducing static electricity at a fuel dispenser. This embodiment of the invention includes providing an ionizer that generates ions for eliminating static electricity, and a blower proximate the ionizer for producing a current of air for dispersing the ions to a desired location. A motion detector is operatively connected to the blower such that detection of motion by the motion detector activates the blower. The ionizer, the blower and the motion detector are positioned proximate a fuel dispenser, whereby motion proximate the fuel dispenser activates the blower to disperse ions proximate the fuel dispenser and reduce static electricity proximate the fuel dispenser.

In another preferred embodiment of the method of using the static electricity eliminator according to the invention, includes providing a housing for containing the ionizer, the blower and the motion detector.

In another preferred embodiment of the method of using the static electricity eliminator according to the invention, the housing is mounted at a base of the fuel dispenser.

In another preferred embodiment of the method of using the static electricity eliminator according to the invention, the blower is positioned such that the ions are moved in front of the fuel dispenser.

In another preferred embodiment of the method of using the static electricity eliminator according to the invention, the motion detector is positioned proximate the fuel dispenser such that the motion detector detects a motorist exiting a vehicle parked in front of the fuel dispenser.

BRIEF DESCRIPTION OF THE DRAWINGS

Some of the objects of the invention have been set forth above. Other objects and advantages of the invention will appear as the invention proceeds when taken in conjunction with the following drawings, in which.

DETAILED DESCRIPTION OF THE INVENTION

Figure 1:
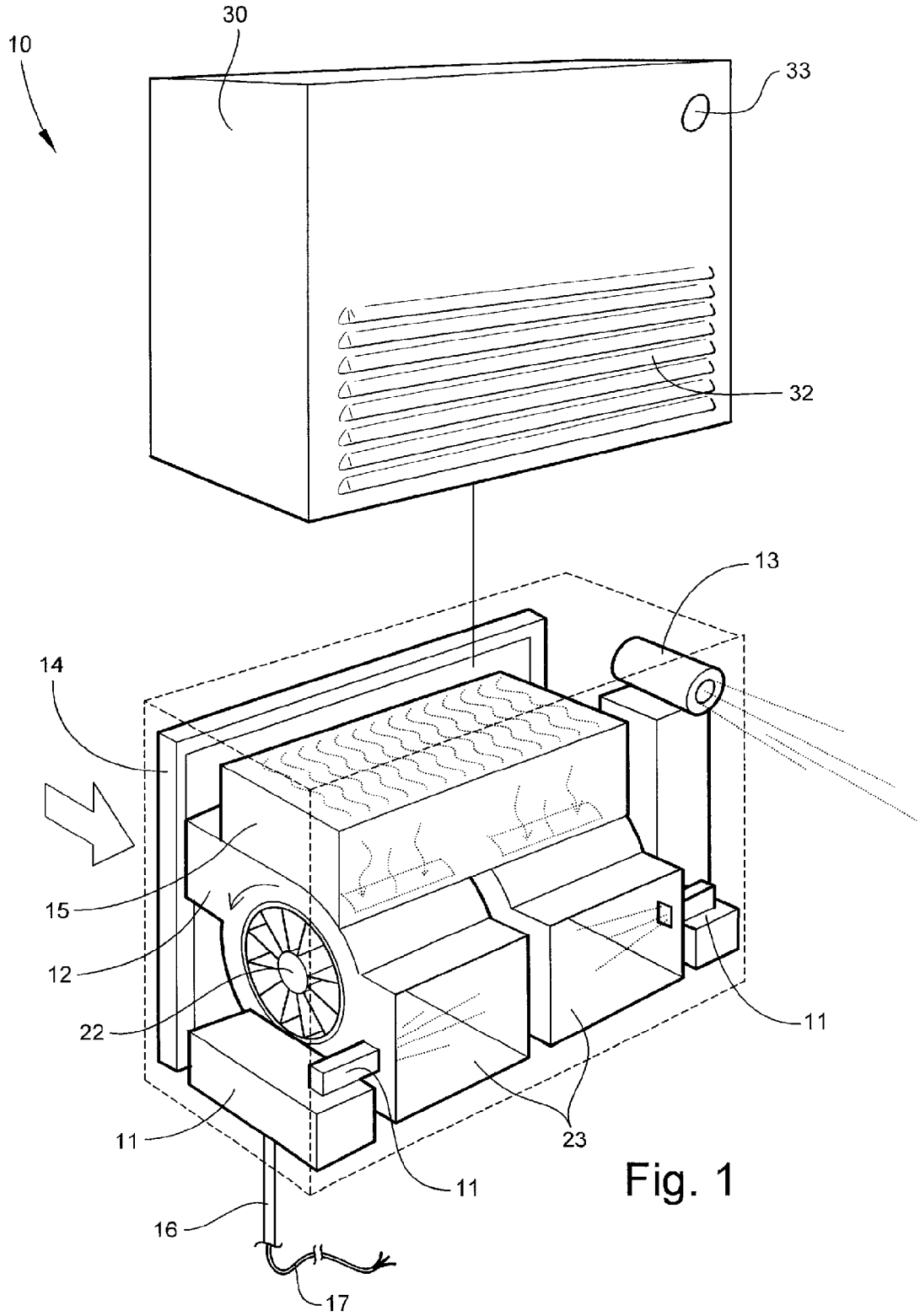
FIG. 1 is a perspective view of a static electricity eliminator according to a preferred embodiment of the invention.

Referring now specifically to the drawings, a static electricity eliminator apparatus according to a preferred embodiment of the invention is illustrated in FIG. 1, and shown generally at reference numeral 10. As shown in FIG. 1, the apparatus 10 comprises an air ionizer 11, a blower 12, and a motion detector 13.

A variety of ionizing devices can be utilized as the air ionizer 11, so long as it generates ions that reduce the amount of static electricity in the air. The terms "eliminator", "eliminate", "reduce" and "reducing", as used throughout this application, refer generally to the apparatus 10 lowering the amount of static electricity, and/or preventing the generation of static electricity in the first place. The terms are not intended to limit the invention, either qualitatively or quantitatively, with regard to the reduction, dissipation, elimination, neutralization and/or prevention of static electricity. The terms encompass, but do not require, a complete elimination or prevention of static electricity.

It is well known that ionization is useful in neutralizing static electricity. For example, U.S. Pat. Nos. 6,739,530, 5,847,917, 3,156,847 and 3,111,605 all disclose air ionizers capable of dissipating static electricity, and are incorporated herein by reference. The ionizer 11 can use a corona discharge to generate ionized air, or an electrically powered X-ray tube which ionizes the air by emitting low energy X-rays. Alternatively, the ionizer can use a radioactive source to ionize the air.

As shown in FIG. 1, the blower 12 preferably comprises a motorized fan 22 and an air chamber 23. Alternatively, the blower 12 can be a pressurized air line, or any other suitable device capable of providing a steady current of air.

Figure 2:
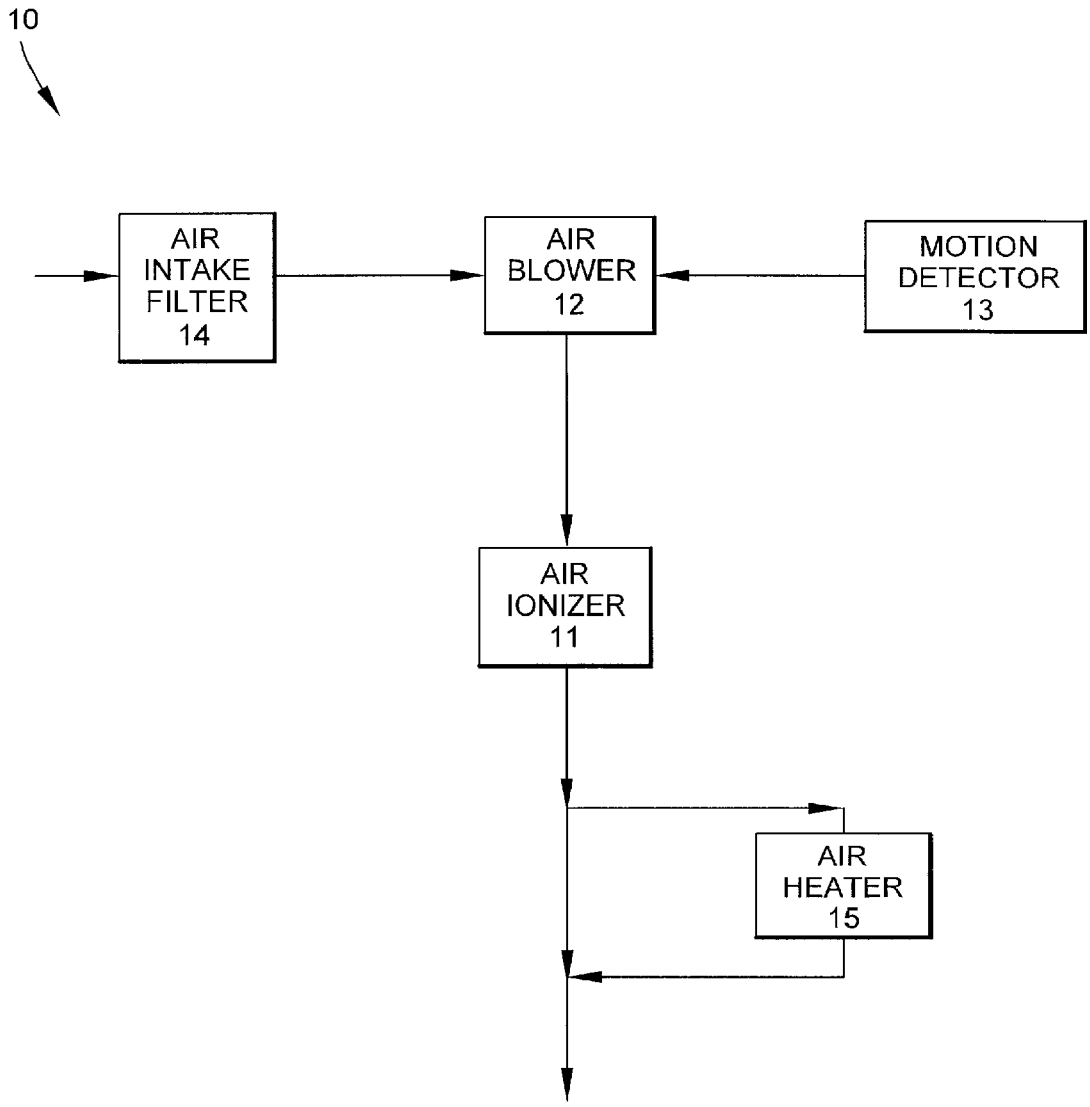
FIG. 2 is a block flow diagram illustrating the static electricity eliminator of FIG. 1.

The apparatus 10 includes an air intake filter 14 connected to the blower 12. As illustrated in FIGS. 1 and 2, airflows into the intake valve 14 and is supplied to the blower 12. The term "air", as used throughout this application, refers generally to any gas or combination of gases, and is not intended to be limiting to any particular gas or mixture of gases. While in the blower 12, the air is ionized by the ionizer 11, generating positively and negatively charged ions that neutralize static electricity. In addition, the air is heated by a heater 15, which further reduces static electricity.

The motion detector 13 is operatively connected to the blower 12, so that upon detecting motion the blower 12 is activated and the fan 22 rotates to blow a current of ionized air out of the chamber 23. Detection of motion by the motion detector 13 also activates the heater 15, so that the current of ionized air being blown by the blower 12 is heated. The blower 12 will continue to blow ionized air as long as the motion detector 13 detects motion. Alternatively, the blower 12 can be programmed to blow ionized air for a predetermined length of time upon activation by the motion detector 13. As such, the blower 12 operates for the predetermined length of time, regardless of whether the motion detector 13 continues to detect any motion. In addition, the apparatus 10 includes a ground 16, and a cord 17 for connecting to a suitable AC power supply for powering the ionizer 11, blower 12, motion detector 13 and heater 15.

As shown in FIG. 1, the apparatus 10 includes a housing 30 that covers all of the above described components. The housing 30 has a plurality of apertures 32 in a grill configuration to allow for the flow of ionized air of the blower 12. There is a similar plurality of apertures on the opposite side of the housing to allow for air to enter into the air intake filter 14. In addition, the housing 30 has an opening 33 to allow for the motion detector to detect motion outside of the housing 30.

Figure 3:
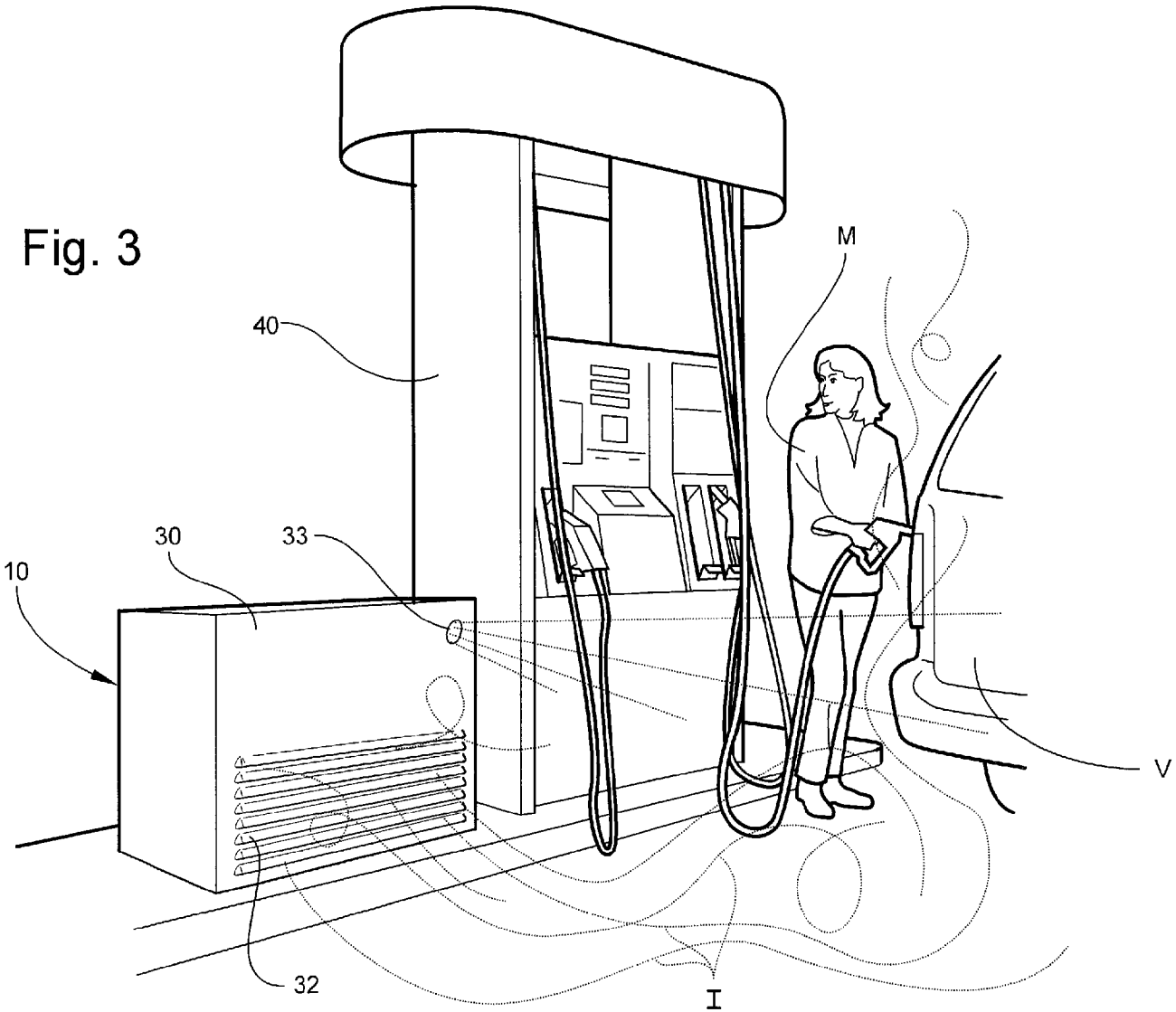
FIG. 3 is an environmental view of the static electricity eliminator of FIG. 1.

A preferred method of using the apparatus 10 is illustrated in FIG. 3. The apparatus 10 is preferably mounted proximate the base of a fuel pump 40. When a motorist "M" exits her vehicle "V", the motion detector senses the motion and activates the blower 12, which then blows a current of ionized air "I" in front of the fuel pump 40. As the motorist "M" moves through the current of ionized air "I", any static electrical charge on the motorist's person is eliminated or prevented prior to beginning the fueling process. The blower 12 continues to operate as long as the motion detector 13 detects motion. If the motorist "M" returns to the interior of her vehicle "V" during the fueling process, an event that particularly increases the risk of a static electricity-induced flash fire, the motion detector 13 detects the motorist's motion and activates the blower 12 again so that another current of ionized air "I" is directed on the motorist "M" upon her return to the fuel pump 40. Alternatively, the blower 12 can be programmed to blow ionized air "I" for a predetermined length of time upon activation by the motion detector 13, as noted above.

As noted above, the motion detector 13 also activates the heater 15. Heating the ionized air helps in the reduction of static electricity, while also improving the comfort of the motorist "M" by counteracting the cold sensation that would otherwise result from the current of ionized air "I" being blown upon the motorist "M". In addition, the motion detector 13 can be operatively linked to the ionizer 11, so that the ionizer 11 is also activated by the detection of motion by the motion detector 13. By maintaining the ionizer 11, blower 12 and heater 15 in an off setting until activation by the motion detector 13, the apparatus 10 conserves energy.

An apparatus for reducing static electricity and method of using same is described above. Various details of the invention may be changed without departing from its scope. Furthermore, the foregoing description of the preferred embodiments of the invention and the best mode for practicing the invention are provided for the purpose of illustration only and not for the purpose of limitation—the invention being defined by the claims.

We claim:

1. An apparatus for reducing static electricity comprising:

(a) an ionizer adapted for generating static electricity reducing ions;

(b) a blower communicating with the ionizer for moving the ions to a desired location;

(c) a motion detector operatively connected to the blower, wherein detection of motion by the motion detector activates the blower whereby ions reduce static electricity at the desired location;

(d) wherein the ionizer, blower and motion detector are adapted for positioning proximate a dispenser of a combustible substance, whereby motion proximate the dispenser activates the blower to disperse ions proximate the dispenser and reduce static electricity proximate the dispenser.

2. An apparatus according to claim 1, wherein the blower is selected from the group consisting of a motorized fan, and a pressurized air line.

3. An apparatus according to claim 1, further comprising an air intake filter for supplying air to the blower.

4. An apparatus according to claim 1, further comprising a timer operatively connected to the blower, whereby the blower operates for a predetermined period of time upon activation by the motion detector.

5. An apparatus according to claim 1, wherein the blower operates upon activation by the motion detector, and continues to operate until the motion detector no longer detects motion.

6. An apparatus according to claim 1, further comprising a housing for containing the ionizer, the blower and the motion detector, and wherein the housing is adapted for positioning proximate the dispenser.

7. An apparatus according to claim 1, wherein the motion detector is operatively connected to the ionizer, wherein detection of motion by the motion detector activates the ionizer.

8. An apparatus according to claim 1, wherein the blower produces a current of air for moving the ions, and further comprising a heating device for heating the current of air, whereby static electricity in the air is reduced.

9. An apparatus according to claim 8, further comprising a housing for containing the ionizer, the blower, the motion detector and the heating device.

10. An apparatus according to claim 9, wherein the motion detector is operatively connected to the heating device, wherein detection of motion by the motion detector activates the heating device.

11. A method for reducing static electricity comprising the steps of:

(a) providing an ionizer adapted for generating static electricity reducing ions;

(b) providing a blower communicating with the ionizer for moving the ions to a desired location;

(c) operatively connecting a motion detector to the blower, whereby detection of motion by the motion detector activates the blower and ions are moved to reduce static electricity at the desired location;

(d) positioning the ionizer, the blower and the motion detector proximate a dispenser of a combustible substance, whereby motion proximate the dispenser activates the blower to move ions proximate the dispenser and reduce static electricity proximate the dispenser.

12. A method according to claim 11, further comprising the step of heating the ions moved by the blower.

13. A method according to claim 11, further comprising the step of providing a housing for containing the ionizer, the blower and the motion detector.

14. A method according to claim 13, wherein the step of positioning the ionizer, the blower and the motion detector proximate a dispenser of combustible fuel comprises mounting the housing at a base of the fuel dispenser.

15. A method according to claim 11, wherein the step of positioning the ionizer, the blower and the motion detector includes positioning the blower such that the blower moves ions in front of the fuel dispenser.

16. A method according to claim 11, wherein the step of positioning the ionizer, the blower and the motion detector includes positioning the motion detector proximate the dispenser such that the motion detector detects a motorist exiting a vehicle parked in front of the dispenser.

17. A fuel dispensing system comprising:

(a) a plurality of fuel dispensers;

(b) at least one ionizer adapted for generating static electricity reducing ions;

(c) a blower in communication with the at least one ionizer and positioned proximate the fuel dispensers such that upon activation the blower directs the ions towards the fuel dispensers; and (d) a motion detector operatively connected to the blower and positioned to detect motion of a motorist exiting a vehicle parked proximate the fuel dispenser, wherein detection of motion by the motion detector activates the blower whereby the ions reduce static electricity proximate the fuel dispensers.

18. A fuel dispensing system according to claim 17, wherein the at least one ionizer is selected from the group consisting of a corona discharge, an electrically powered X-ray tube emitting low energy X-rays, and a radioactive source.

19. A fuel dispensing system according to claim 17, further comprising a timer operatively connected to the blower, whereby the blower operates for a predetermined period of time upon activation by the motion detector.

20. A fuel dispensing system according to claim 17, further comprising a housing containing the at least one ionizer, the blower and the motion detector, wherein the housing is positioned proximate the fuel dispensers.

* * * * *